US005755633A

United States Patent [19]

Marquez

[11] Patent Number: 5,755,633

[45] Date of Patent: May 26, 1998

[54] TENNIS STROKE TRAINING AND EXERCISE DEVICE

[76] Inventor: Humberto Al Marquez, 1486 Midfield Ave., San Jose, Calif. 95122

[21] Appl. No.: 777,749

[22] Filed: Dec. 21, 1996

[51] Int. Cl.[6] ..... A63B 61/00

[52] U.S. Cl. ..... 473/463; 473/521

[58] Field of Search ..... 473/151, 221, 473/220, 223, 224, 226, 463, 521

[56] References Cited

U.S. PATENT DOCUMENTS

| | | | |
|---|---|---|---|
| 1,536,255 | 5/1925 | Beal | 473/463 |
| 3,801,099 | 4/1974 | Lair | 473/463 |
| 3,934,876 | 1/1976 | Haddad | 473/463 |
| 4,183,526 | 1/1980 | Brown | 473/463 |
| 5,316,296 | 5/1994 | Zirma | 473/463 |
| 5,324,029 | 6/1994 | Kim | 473/463 |

*Primary Examiner*—Theatrice Brown
*Attorney, Agent, or Firm*—John J. Leavitt

[57] ABSTRACT

A stroke training and exercise device includes a hand-grip portion having the configuration of the handle of a tennis racket, a throat portion similar to a tennis racket, but a much smaller head band within which is secured, either permanently or detachably, a monolithic disk or "head" that selectively incorporates variable weights that cause the device to simulate the weight and balance of various types of tennis rackets.

7 Claims, 2 Drawing Sheets

TENNIS STROKE TRAINING AND EXERCISE DEVICE

BACKGROUND OF THE INVENTION

1. Field of the Invention

This invention relates to tennis and particularly to a stroke training and exercise device that will, when appropriately used, increase the talent and physical fitness of a tennis player.

2. Description of the Prior Art

A priliminary patentability and novelty search has not been conducted in connection with this invention. It is not known whether there exists devices apart from tennis rackets per se that may be used for developing and enhancing the fitness of the human body to play the game of tennis.

The game of tennis is a fast-paced game that requires the tennis player, as an individual, to make every play. It is not a team-type of sport (except in doubles play) in which other individuals on the team contribute to the game. Because it is so fast-paced, it requires stamina over time not usually required in other sports. For instance, in football, there are eleven people on the team and each contributes to a play in a manner that makes it the concerted effort of all that determines the result of the play. After each play, there is a time interval during which each of the players, regardless of the nature of his participation in the previous play, can recover physically from his physical exertion in the previous play. Baseball, in like manner, includes spurts of strenuous activity by one or more players, but compared to football and tennis, particularly tennis, is a relatively slow-paced game. It is therefore extremely important that a tennis player maintain his or her body as physically fit as possible within the usual constraints of time and other activities, to develop enough stamina to play another set, or to gallop to the net more quickly, and most importantly, to stave off injury from such activities.

Accordingly, one of the important objects of the present invention is the provision of a stroke training and exercise device that will enable tennis players to maintain fitness of their bodies even when a tennis court and a tennis racket are not available or are inappropriate to use.

Two of the more serious injuries encountered by tennis players are Achilles tendonitis and shin splints. A relatively new injury that is developing is "tennis hip". It is proposed that the way to avoid these injuries is to maintain the body in top physical condition at all times, not just by playing tennis. Accordingly, another object of this invention is the provision of a tennis stroke training and exercise device that simulates a tennis racket in weight, balance and handling, but which is much smaller and can be used in close quarters to continue effective stroke practice and exercising to maintain the body in peak condition.

The invention possesses other objects and features of advantage, some of which, with the foregoing, will be apparent from the following description and the drawings. It is to be understood however that the invention is not limited to the embodiment illustrated and described since it may be emobodied in various forms within the scope of the appended claims.

SUMMARY OF THE INVENTION

In terms of broad inclusion, the stroke training and exercise device of the invention is particularly developed for use by tennis players to provide a device of small size which simulates the weight and balance of a tennis racket to enable the practice of strokes and to do exercises of the type that are inherent in playing the game of tennis. Structurally, the stroke training and exercise device of the invention comprises a handgrip portion having the general configuration of the handle of a tennis racket, a throat portion similar to a tennis racket, but a much smaller head band within which is positioned, either permanently or detachably, a disk or "head" that incorporates, or may be modified to incorporate, various weights that simulate the weight and balance of various types of tennis rackets.

DESCRIPTION OF THE PREFERRED EMBODIMENT

Figure 1:
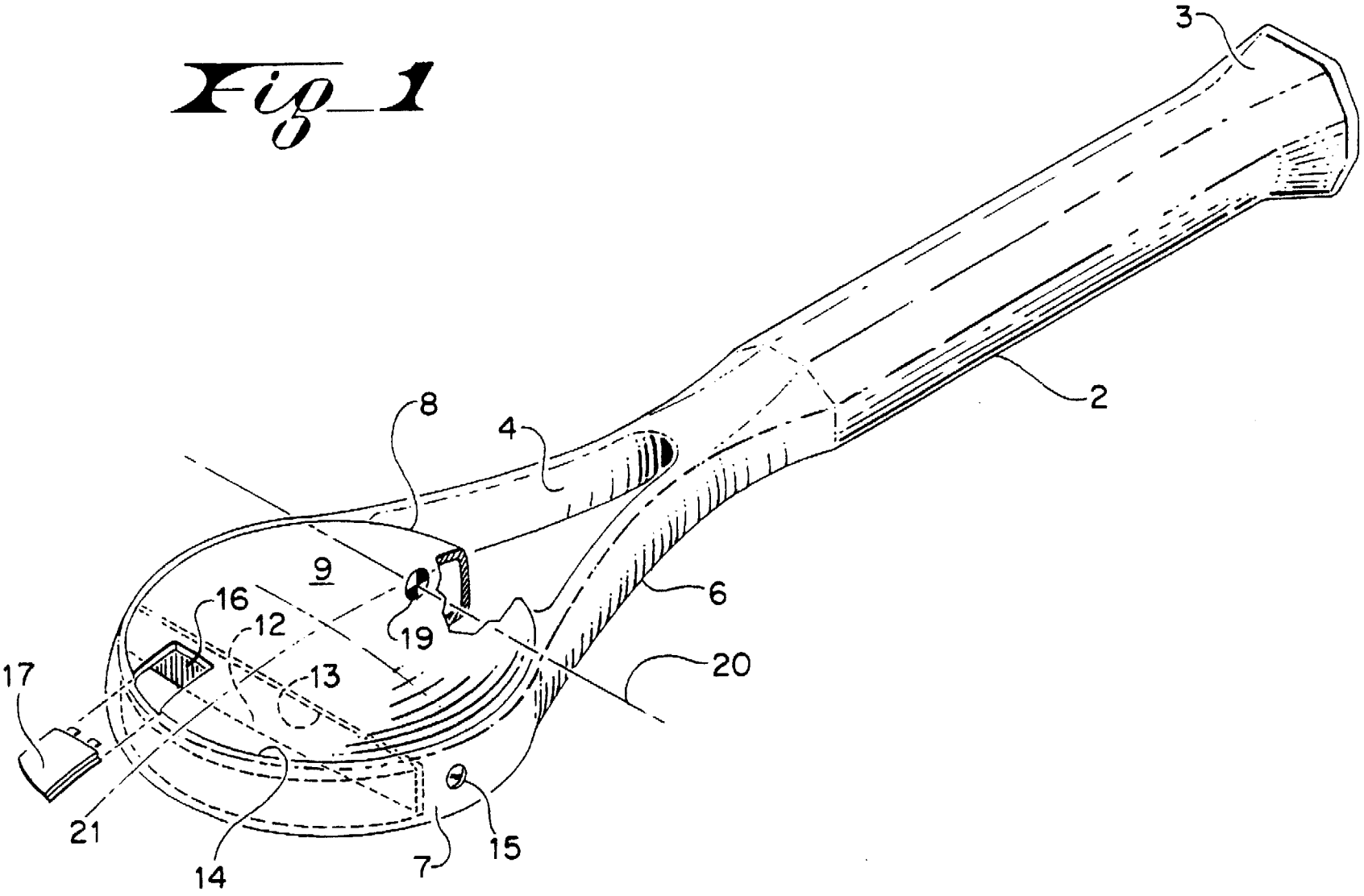
FIG. 1 is a perspective view illustrating the tennis stroke training and exercise device of the invention, a portion of the head being broken away to show the underlying structure.
Figure 2:
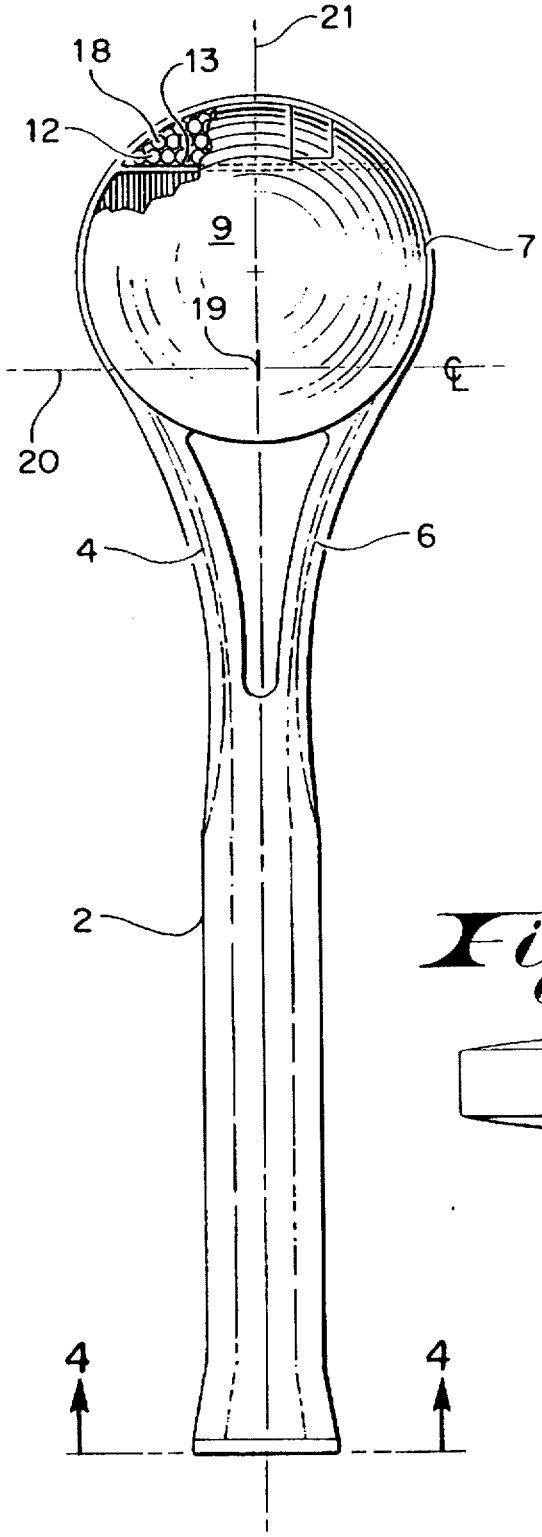
FIG. 2 is a rear plan view of the tennis stroke training and exercise device, a portion broken away to show underlying structure.
Figure 3:
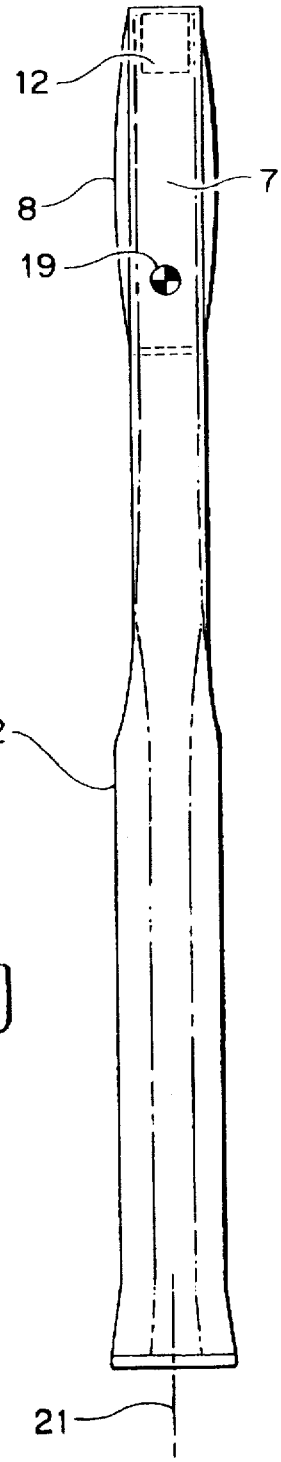
FIG. 3 is an edge view of the tennis stroke training and exercise device.
Figure 4:
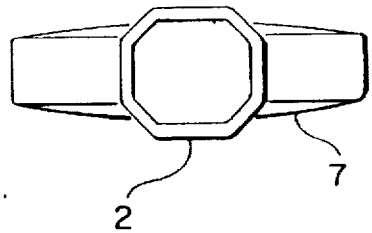
FIG. 4 is an end view taken in the direction of the arrows 4—4 in FIG. 2.

In terms of greater detail, the tennis stroke training and exercise device of the invention is intended to provide a device that any tennis player or other person, whether he be a novice player, an intermediate or advanced player, even a professional player, can use at times when a tennis court and a tennis racket are not available. It is imperative with tennis players that they maintain a high degree of flexibility, stamina, speed and athletic musculature. Some tennis players appear to be "born champions" because they naturally possess many of these attributes over their entire tennis playing lifespan. It has been reported, for instance, that Andre Agassi's father hung a tennis ball over his crib when Andre was only two months old, and that Andre's eyes locked on the ball and followed its movement. Obviously, not every one has the natural attributes of fast, sharp eyes and the concentration to follow a ball intuitively. Most tennis players are sturdy and strong and have the will and determination to improve their game but must work continuously to maintain their body in a fit condition to participate in this fast-paced and physically demanding game. It is therefore necessary for a would-be tennis player to practice strokes that will enhance his or her flexibility and simultaneously provide the mental concentration that is necessary to perform the stroke time-after-time and thereby develop the musculature that is necessary to achieve such strokes with finesse and accuracy and the power required for every situation encountered.

Referring to the drawings, it will be seen that the tennis stroke and exercise device of the invention includes a handle designated generally by the numeral 2, that simulates the handle of a convention tennis racket, or which duplicates the structure of a conventional tennis racket, including the radially outwardly expanded butt 3 of the handle that prevents the hand, particularly when it is moist with perspiration, from slipping off of the handle 2. Preferably, the handle is fabricated from the same materials that are utilized to fabricate a tennis racket handle, but conveniently may be formed from many different materials including plastic, wood, fiber-glass, graphite, aluminum, "Kevlar", boron and ceramic.

From the handle 2, there extend two integral diverging beams 4 and 6 that merge smoothly into a circular holding rim or band 7. Within the rim is trapped a monolithic head 8, preferably of circular configuration, and fabricated from any appropriate material, preferably plastic, and configured to provide a major hollow portion 9 and a smaller interior recess 12 defined on the one hand by a transversely extending chord surface or integral wall 13 formed with the hollow portion 9, and a rim portion 14 caught within the circular member 7 that merges smoothly with the beams 4 and 6. The circular head 8 is conveniently secured detachably within the head band by appropriate screws 15 driven through the band and into the head at diametric locations as shown. Alternatively, the head 8, beams 4 and 6, rim 7 and handle 2 may be manufactured as one unitary structure.

An aperture 16 is provided in the rim portion of the head that has been hollowed out to form the recess 12, the aperture providing access to the interior of the recess 12. The aperture is provided with a lid 17 that may be manipulated to close or open the aperture 16 into the hollow interior 12. The purpose of the opening 16 is to enable the insertion into the recess 12 of a suitable material to provide adjustability of the weight of the head, preferably a quantity of lead shot 18, which is calculated in weight to place the center of gravity 19 at the intersection of a transverse plane 20 and a longitudinal axis 21. Obviously, where the device comprises a unitary structure as discussed above, the opening 16 with attendant closure 17 are omitted, and the spacial postion of the center of gravity is stationary rather then adjustable.

The weight of the handle, combined with the weight of the remainder of the structure, with or without the lead shot 18 contained within the recess 12, places the center of gravity 19 at very close to the same position of the center of gravity that exists for a conventional tennis racket.

It will thus be seen that the tennis stroke training and exercise device of the invention may be utilized for practicing all tennis strokes, without the use of tennis balls or a tennis racket, and enables practice of the forehand stroke, the backhand stroke, volleys and serves in areas that are restricted in space and in a manner to emmulate the use of the racket that an individual tennis player is accustomed to using. Thus, by modifying the amount of lead shot 18 included within the hollow chamber 12 of the head 8, the center of gravity 19 may be shifted one way or the other along the longitudinal center line 21 of the exercise device, thus matching the weight and center of gravity of the exercise device to the racket that a particular tennis player is accustomed to using.

As most tennis players know, it is important to practice the strokes that are used in a tennis match in order to develop the muscles, and to also develop muscle memory for the performance of a given stroke. Thus, one of the advantages of utilizing a stroke training and exercise device such as that described herein and forming the subject matter of the present invention, is that it enables the tennis player to simulate with a relatively small device the actual strokes that he or she would make in an actual tennis match, the tennis player musculature having built-in memory for each of the strokes that has been practiced, and the muscles that are involved in the effective performance of that stroke being developed to the point that it gives the tennis player a significant "edge" in performing the stroke accurately.

Many individuals would like to play tennis but for many reasons believe that they are not sufficiently physically fit to withstand the physical and mental stress and exertions that are needed to play a tennis match. The stroke training and exercise device of this invention provides the opportunity for people that have never played tennis to exercise their bodies in a way that simulates the use of an actual tennis racket, and therefore provides them with the confidence that is necessary to actually play a tennis match. Since most individuals who are not adept at participaing in a sport such as tennis are somewhat reluctant to be seen in public, another advantage of this tennis stroke training and exercise device is that it may be used in-doors in all types of weather, and in the privacy of a location not open to the public, thus eliminating from the would-be tennis player or novice, the self-consciousness and fear that would be generated by exposing his stroke mistakes to the public.

From the foregoing it will of course be clearly understood that the device is not limited to manufacture in one size and weight. Since tennis players of all ages and degrees of proficiency and physical condition need the exercise and training that the device described and illustrated will provide when used consistently, exercise and training devices of many different sizes and weights, to fit the needs of all tennis players, may be manufactured.

Having thus described the invention, what is believed to be new and novel and sought to be protected by Letters Patent of the United States is as follows.

I claim:

1. A tennis stroke training and exercise device adjustable to correspond to the weight and balance of a selected conventional tennis racket for the purpose of enabling the practice of tennis strokes in a confined area and without the use of tennis balls and for exercising the body to develop musculature and memory in such musculature for performing specific tennis strokes, comprising:

a) a handle member adapted to be grasped in the hand and having a length and configuration of the handle of a selected conventional tennis racket;

b) a monolithic head on one end of said handle member; and c) means on said monolithic head for selectively adjusting the combined weight and balance of said handle member and monolithic head to correspond to the weight and balance of a selected tennis racket.

2. The tennis stroke training and exercise device according to claim 1, wherein said head is axially spaced from said handle member, and means are provided retaining said monolithic head in axially spaced relation to said handle member.

3. The tennis stroke training and exercise device according to claim 2, wherein said monolithic head comprises a circular body having a peripheral rim, and said means retaining said monolithic head axially spaced from said handle member includes a pair of beams connected at one end to said handle member and diverging therefrom to merge about said peripheral rim of said circular body.

4. The tennis stroke training and exercise device according to claim 3, wherein said means for selectively adjusting the combined weight and balance of said handle member and said monolithic head includes a recess in said monolithic head, variable weight means enclosed within said recess, and said beams engaging said peripheral rim of said monolithic head substantially circumscribe said peripheral rim of said circular body.

5. A tennis stroke training and exercise device adjustable to correspond to the weight and balance of a selected conventional tennis racket for the purpose of enabling the practice of tennis strokes in a confined area and without the use of a tennis racket and tennis balls and for exercising the body to develop musculature and memory in such musculature for performing specific tennis strokes, comprising:

a) a handle member adapted to be grasped in the hand and having a length and configuration of the handle of a selected conventional tennis racket;

b) a monolithic head on one end of said handle member;

c) means on said monolithic head for selectively adjusting the combined weight and balance of said handle member and monolithic head to correspond to the weight and balance of a selected tennis racket; and d) said means for selectively adjusting the combined weight and balance of said handle member and said monolithic head includes a recess in said monolithic head, and selectively variable weight means enclosed within said recess.

6. The tennis stroke training and exercise device according to claim 5, wherein said monolithic head is circular and possesses a circular peripheral rim, said recess is formed in said circular peripheral rim and is defined by a chordal surface intercepting said circular peripheral rim and a pair of spaced and parallel arcuate portions extending from said chordal surface to said circular peripheral rim, and said means retaining said monolithic head axially spaced from said handle member includes a pair of beams including an integral portion diverging therefrom to encircle and engage said circular peripheral rim, said recess being sealed by said integral portion encircling said circular peripheral rim, and means on at least one of said spaced and parallel arcuate recess wall portions manipulable to close or open said recess to retain or remove said variable weight means from said recess.

7. A tennis stroke training and exercise device adjustable to correspond to the weight and balance of a selected conventional tennis racket for the purpose of enabling the practice of tennis strokes in a confined area and without the use of a tennis racket and tennis balls and for exercising the body to develop musculature and memory in such musculature for performing specific tennis strokes, comprising:

a) a handle member adapted to be grasped in the hand and having a length and configuration of the handle of a selected conventional tennis racket;

b) a monolithic head on one end of said handle member;

c) means on said monolithic head for selectively adjusting the combined weight and balance of said handle member and monolithic head to correspond to the weight and balance of a selected tennis racket;

d) said head being axially spaced from said handle member, and means are provided retaining said monolithic head in axially spaced relations to said handle member;

e) said monolithic head comprising a circular body having a peripheral rim, and said means retaining said monolithic head axially spaced from said handle member includes a pair of beams connected at one end to said handle member and diverging therefrom to merge about said peripheral rim of said circular body; and f) said means for selectively adjusting the combined weight and balance of said handle member and said monolithic head includes a recess in said monolithic head, selectively variable weight means enclosed within said recess, and said beams engaging said peripheral rim of said monolithic head substantially circumscribe said peripheral rim of said circular body.

* * * * *